United States Patent [19]

Sullivan, Jr.

[11] 4,285,785

[45] Aug. 25, 1981

[54] METAL PRODUCING METHOD

[75] Inventor: Daniel A. Sullivan, Jr., Upper Burrell Township, Westmoreland County, Pa.

[73] Assignee: Aluminum Company of America, Pittsburgh, Pa.

[21] Appl. No.: 85,856

[22] Filed: Oct. 18, 1979

[51] Int. Cl.[3] ..... C25C 3/00; C25C 3/04; C25C 3/06; C25C 3/26

[52] U.S. Cl. ..... 204/64 R; 204/64 T; 204/65; 204/66; 204/67; 204/68; 204/69; 204/70; 204/71

[58] Field of Search ..... 204/64 R, 64 T, 243 R, 204/244, 65–71, 247

[56] References Cited

U.S. PATENT DOCUMENTS

| | | | |
|---|---|---|---|
| 3,017,336 | 1/1962 | Olstowski | 204/67 |
| 3,761,383 | 9/1973 | Blackhurst et al. | 204/268 |
| 4,118,292 | 10/1978 | Fray et al. | 204/64 R |
| 4,124,453 | 11/1978 | Fleischmann et al. | 204/72 |

FOREIGN PATENT DOCUMENTS

| | | | |
|---|---|---|---|
| 183316 | 4/1963 | Sweden | 204/67 |
| 309605 | 7/1930 | United Kingdom | 204/67 |

*Primary Examiner*—Howard S. Williams

[57] ABSTRACT

In the production of metal by electrolysis of a metal compound dissolved in a molten solvent, the electrolysis is carried out with a bed of conductive pebbles.

6 Claims, No Drawings

METAL PRODUCING METHOD

BACKGROUND OF THE INVENTION

The present invention relates to a method of producing metal by electrolysis carried out in a molten solvent and more particularly to the production of aluminum by such technique.

Over the years, the metallurgical industry has made various efforts to move to bipolar cells. There are the efforts regarding $AlCl_3$ electrolysis—see e.g. U.S. Pat. No. 3,893,899. And, there are the $Al_2O_3$ efforts—see e.g. U.S. Pat. No. 3,178,363. The $Al_2O_3$ effort has been hampered by the consumption of the carbon electrodes. All efforts heretofore are characterized by the studious application of broad plates as electrodes.

In other areas of chemistry, there has arisen the idea of carrying out bipolar processes in beds of particles. See e.g. U.S. Pat. Nos. 3,761,383 and 4,124,453.

Beds of particles have also been used as one of the electrodes in cells. See U.S. Pat. Nos. 3,703,446, 3,716,459, and 3,770,503 and *Erzmetall,* Volume 30 (Sept. 1977), No. 9, pages 365 to 369.

SUMMARY OF THE INVENTION

My invention is to make use of a bed of conductive pebbles to produce metal by the electrolysis route from a metal compound dissolved in a molten solvent. To the best of my knowledge, this idea has never occurred before to those in my art. It represents a major simplification that will save all the effort that has been previously put to making bodies of broad surface as electrodes in such processes. It additionally represents a solution to the problem of how to accommodate the fact that, in $Al_2O_3$ electrolysis, the carbonaceous anode surfaces get consumed—the solution of the present invention is just to introduce new carbon pebbles into the bed.

DESCRIPTION OF THE PREFERRED EMBODIMENTS

I carry out preferred embodiments of my invention either using a fixed bed or a fluidized bed, and I incorporate by reference the above-mentioned U.S. Pat. No. 3,761,383 of Backhurst et al., issued Sept. 25, 1973, as a foundation on which to describe my fixed bed embodiment. Incorporated here by reference is the above-mentioned U.S. Pat. No. 4,124,453 of Fleischmann et al., issued Nov. 7, 1978, as a foundation on which to describe my fluidized bed embodiment.

a. The Fixed Bed Embodiment

Regarding the fixed bed embodiment, the conductive pebbles are carbonaceous pebbles of e.g. ½-inch maximum dimension and the insulating pebbles are similarly sized, or smaller (to minimize the voltage drop through the molten solvent), silicon oxynitride in the case of $AlCl_3$ electrolysis (see U.S. Pat. No. 3,785,941) and alpha alumina in the case of $Al_2O_3$ electrolysis (see U.S. pat. No. 3,766,025—new insulating pebbles are mixed into the bed when the slow dissolution of the alpha alumina so requires, just as new carbon pebbles are mixed in as carbon consumption proceeds in such $Al_2O_3$ electrolysis with evolution of CO and $CO_2$). The pebbles may have a spherical shape.

Backhurst's electrodes 15 and 16 are carbon in this embodiment, with holes therethrough, the holes being sized less than the pebbles to retain the pebbles in the bed and permit electrolyte, i.e. molten solvent and dissolved compound, circulation and gas escape. The anode is replaced from time to time in the $Al_2O_3$ electrolysis case, due to its consumption, but most of the carbon supply is from the pebbles.

Circulation is by use of gas-lift techniques (see U.S. Pat. No. 3,893,899) or by pumping (see U.S. Pat. No. 2,830,940). The metal is made to occur in the liquid state by suitable choice of electrolyte temperature and is tapped above, or below (in a sump), Backhurst's electrode 15 (my cathode), depending on the effective porosity of the electrode. The electrolyte circulation direction is chosen as desired. It is e.g. possible to circulate electrolyte upwards through the bed, with the produced metal sinking downwards, a it does in the passage 35 in the above-referenced U.S. Pat. No. 3,893,899. Another choice is to circulate the electrolyte horizontally across the bed, whereby there occurs a separation of upwardly migrating, evolved gas and downwardly migrating, produced metal, as the electrolyte moves across the bed; in the case here, porous alpha alumina or silicon oxynitride vertical walls are used to permit the electrolyte to move sideways into and out of the bed. The effective inner wall of Backhurst may also be frozen electrolyte (see U.S. Pat. No. 881,934), or silicon oxynitride.

The voltage between my electrodes 15 and 16 is chosen to make use of the carbon pebbles in a bipolar fashion—see the discussions in U.S. Pat. Nos. 3,761,383 and 4,124,453. The broad plate electrode, 12-compartment, $AlCl_3$ cell of U.S. Pat. No. 4,119,504 had 31 volts across it. Sixteen volts were used in the 10-compartment, $Al_2O_3$ cell of U.S. Pat. No. 3,730,859.

b. The Fluid Bed Embodiment

Many of the choices made for the fixed bed embodiment hold equally well for the fluidized bed embodiment, as will be self-evident to those skilled in the art. Fleischmann's electrodes 12 and 13 are made of carbon in the application of my invention to aluminum production. Base 14 is silicon oxynitride in the $AlCl_3$ electrolysis case and alpha alumina in the $Al_2O_3$ electrolysis case. When electrode 12 and base 14 are made as one piece by making the electrical current flow vertical, then they are porous carbon as described above for the fixed bed. Aluminum is preferably collected below base 14 in a sump.

c. Conclusion

There has thus been provided a new type of electrolysis method for producing metal in molten solvent. This method eliminates the necessity for manufacturing broad bipolar plates. It is also advantageous in the electrolysis of $Al_2O_3$, since new carbon can simply be mixed into the bed as carbon is consumed.

What is claimed is:

1. In a method for producing metal by electrolysis of a metal compound dissolved in a molten solvent, electrolysis of the metal compound yielding metal and gas, the improvement comprising carrying out the electrolysis in a bipolar mode with a bed of conductive pebbles to create a three phase system of metal, gas, and molten solvent.

2. A method as claimed in claim 1, wherein the metal compound is $Al_2O_3$ and the pebbles are carbonaceous.

3. A method as claimed in claim 1, wherein the metal compound is $AlCl_3$ and the pebbles are carbonaceous.

4. A method as claimed in claim 1, wherein the bed is operated, with the bed being fluidized.

5. A method as claimed in claim 1, wherein the bed is operated, with the bed being fixed, with conductive pebbles being separated by insulating pebbles.

6. A method as claimed in claim 1, wherein the molten solvent and dissolved metal compound are circulated horizontally across the bed, with said gas upwardly migrating and said metal being produced in the liquid state and downwardly migrating to produce a separation of metal and gas.

* * * * *